US005273164A

United States Patent [19]

Lyon

[11] Patent Number: 5,273,164

[45] Date of Patent: Dec. 28, 1993

[54] SOIL CONDITIONING APPARATUS

[76] Inventor: John A. Lyon, 6891 N. Park Extension, Bristolville, Ohio 44402

[21] Appl. No.: 953,859

[22] Filed: Sep. 30, 1992

[51] Int. Cl.[5] ..... B07B 1/28

[52] U.S. Cl. ..... 209/315; 209/409; 298/1 V

[58] Field of Search ..... 209/235, 315, 317, 318, 209/319, 321, 322, 417, 409, 261; 298/1 V, 2, 7, 10

[56] References Cited

U.S. PATENT DOCUMENTS

| | | | |
|---|---|---|---|
| 2,132,165 | 10/1938 | Henry | 209/320 X |
| 3,343,876 | 9/1967 | Rapp | 298/1 V |
| 4,271,011 | 6/1981 | Spencer et al. | 209/417 X |
| 4,340,469 | 7/1982 | Archer | 209/315 |
| 4,923,597 | 5/1990 | Anderson et al. | 209/315 X |

FOREIGN PATENT DOCUMENTS

| | | | |
|---|---|---|---|
| 2223963 | 4/1990 | United Kingdom | 209/315 |

OTHER PUBLICATIONS

Specifications of "Screen-All Model RD-40A" by The Read Corporation.

*Primary Examiner*—Joseph E. Valenza
*Assistant Examiner*—Tuan N. Nguyen
*Attorney, Agent, or Firm*—Lee A. Germain; Ray L. Weber

[57] ABSTRACT

This invention provides a soil conditioning apparatus having a shaker screen assembly that is mounted for operation on the dump bed of wheeled load-carrying vehicles. The shaker screen assembly may be adapted to operate either electrically or hydraulically using available systems on the vehicle and to operate with multiple soil conditioning screens to provide multiple stages of soil conditioning. The conditioned soil materials are deposited directly into the vehicle bed for transport to and dump-delivery at the site or location where it is needed, and this, without having to remove the apparatus from the transporting vehicle.

19 Claims, 3 Drawing Sheets

SOIL CONDITIONING APPARATUS

FIELD OF THE INVENTION

This invention generally pertains to soil conditioning apparatus which conventionally includes a screen which is positioned to pass particulates of a desired size through it to generate a conditioned soil such as, for example, a topsoil as may be used for landscaping purposes.

More particularly, this invention provides a soil conditioning apparatus which is mountable on and carried by a vehicle such that conditioned soil may be processed and collected directly into the vehicle load carrying bed as soil particulates pass through the apparatus.

Specifically, this invention provides a soil conditioning apparatus comprised of at least one screen carried by a shaker assembly which is mountable above a dump bed of a vehicle such that various type soils which are deposited onto the screen may be separated by particulate size and collected directly into the dump bed while tailings of the soil are passed off to fall to either side of the vehicle as the shaker assembly is vibrated. The conditioned soil may be transported directly to the site and deposited by the dump mechanism of the vehicle.

BACKGROUND OF THE INVENTION

For many years various types of soil materials were conditioned by using large screens which were mounted in a frame disposed at a substantially steep angle such that soil materials deposited at the top end of the screen would fall to the bottom end via gravity and particulates passable through the screen would fall to the ground beneath the screen. The pile of screened soil particulates would then be shovelled up and loaded into truck vehicles for transport to the site or location where it was to be used.

It was found, however, that the processing time for this type of soil conditioning could be shortened by mounting the screen to a shaker assembly so as to effect vibration of the soil materials as they were deposited onto the screen. The vibration of the screen not only helped to pass soil particulates through the screen openings but it also facilitated the break-up of larger chunks of material such that more of it was effectively conditioned than was heretofore possible with the non-vibrating screen apparatus. These types of soil conditioning apparatus, however, were conventionally large and heavily-built structures which were not moved very often as to do so was a costly proposition.

More recently, the industry has recognized the need for a more portable soil conditioning apparatus and one such device is manufactured by the Read Corporation of Middleboro, Mass. The apparatus is known by the tradename "SCREEN-ALL" and it comprises a shaker-mounted screen which is carried on a wheeled framework such that it may be towed behind a vehicle in the manner of a trailer. Once at the site where it is to be used, the apparatus is set up in a substantially stationary position and soil materials are deposited onto a vibrating screen from one side of the apparatus while the tailings of material are collected off of the opposite side. The conditioned soil is collected on the ground beneath the screen where it may be shovelled up and loaded into a truck for transport to the site or location where it is to be used.

There are some obvious disadvantages found in these prior art devices. Firstly, both the stationary screen and the towed shaker screen apparatus may only be loaded from a single side while soil tailings are deposited in front or at an opposite side of the respective apparatus. In either case, the pile-up of soil tailings must be periodically removed such that soil conditioning may be continued. In addition, the conditioned soil is deposited on the ground beneath the screen where it must be shovelled up and loaded into a truck for transport to the site where it is to be used. With respect to the towed shaker screen apparatus, it is a costly apparatus because it includes a wheeled carriage so that it may be towed and it further includes all of the necessary power equipment for its operation.

It is, therefore, in accordance with one aspect of the present invention an object to provide a soil conditioning apparatus which may be mounted on the dump bed of a wheeled vehicle such that soil materials may be conditioned and deposited directly into the dump bed for immediate transport and delivery to the site where it is to be used.

According to another aspect of the invention it is an object to provide a soil conditioning apparatus which is less costly to manufacture using conventional methods and materials and which may be adapted to use the available power systems of the wheeled vehicle on which it is to be carried and used.

In accordance with still another aspect of the invention it is an object to provide a soil conditioning apparatus which may be loaded from multiple positions while tailings of soil materials are deposited off of two sides of the apparatus and such tailings may not interfere with continued soil conditioning inasmuch as the apparatus may be easily repositioned for continued operation.

According to another aspect of the present invention it is an object to provide a soil conditioning apparatus which may be adapted to carry multiple and various type of screens within a shaker screen assembly such that multiple stages of soil conditioning may be accomplished.

According to still another aspect of the invention it is an object to provide a soil conditioning apparatus which may utilize the available hydraulic system of a conventional dump truck to operate hydraulic eccentric vibrator motors, which motors effectively vibrate a shaker screen assembly to obtain properly conditioned soil.

In accordance with another aspect of the invention it is an object to provide a soil conditioning apparatus which may be adapted to operate a shaker screen assembly using electrically driven eccentric vibrator motors.

According to another aspect of the present invention it is an object to provide a soil conditioning apparatus wherein soil materials may be conditioned directly into the dump bed of a truck vehicle using the available hydraulic system and wherein the truck operator may operate both the dump bed mechanism and the shaker screen assembly of the apparatus from the truck cab location and the shaker screen vibration speed is varied by the operator using the engine accelerator of the truck.

SUMMARY OF THE INVENTION

The beforementioned aspects, objects, and advantages of the present invention may be accomplished in an apparatus for screen-conditioning soil materials into a vehicle having a dump bed which may be operated either mechanically, electrically, or hydraulically by a comparable system available on the vehicle, the apparatus comprising a frame having forwardly and rearwardly positioned members affixed to the dump bed of the vehicle; a shaker screen assembly mounted within and carried by the frame between the forwardly and rearwardly positioned members, the assembly comprising at least one soil conditioning screen carried on a structure which is spring-mounted with respect to the forwardly and rearwardly mounted frame members, and, a pair of eccentric vibrator motors mounted to the shaker screen assembly and operated by a power system of the vehicle to effect vibratory motion of the screen such that soil materials deposited onto the assembly may be screen-conditioned directly into the vehicle dump bed.

BRIEF DESCRIPTION OF THE DRAWINGS

The features and advantages of the present invention will be better understood and appreciated from a consideration of the following detailed description of the preferred embodiments when taken in conjunction with the accompanying drawings, in the several figures in which like parts and/or elements bear like reference numerals and wherein.

DETAILED DESCRIPTION OF THE INVENTION

Figure 1:
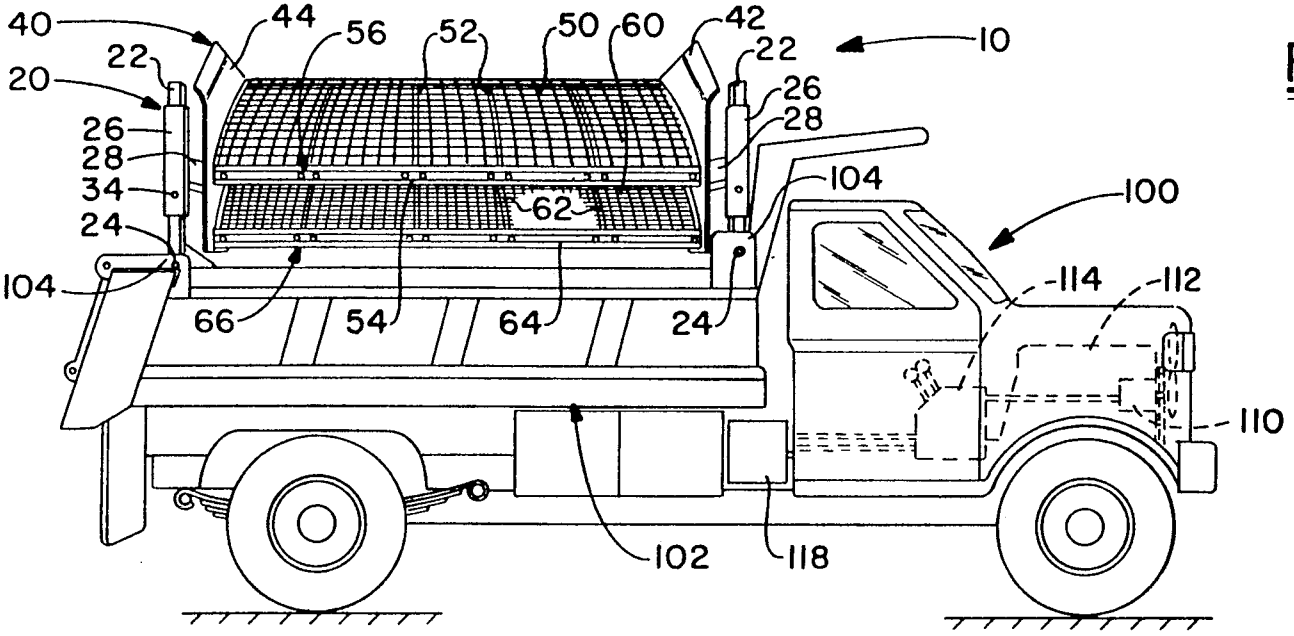
FIG. 1 is a side view illustrating the application of a soil conditioning apparatus according to the invention as it may be applied to a dump truck of conventional design.
Figure 3:
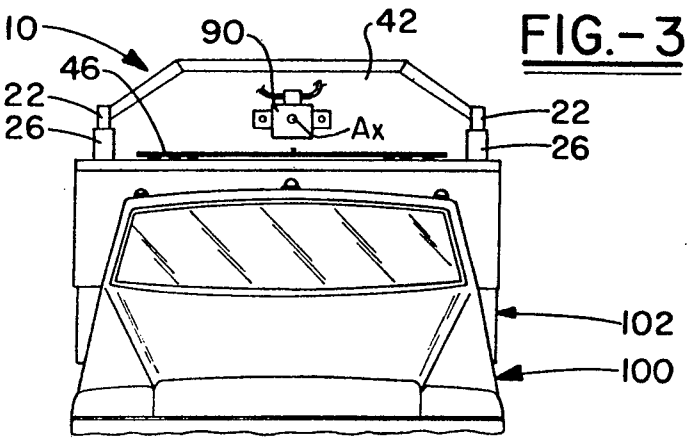
FIG. 3 is a partial front view of the apparatus and truck illustrated in FIG. 1.
Figure 2:
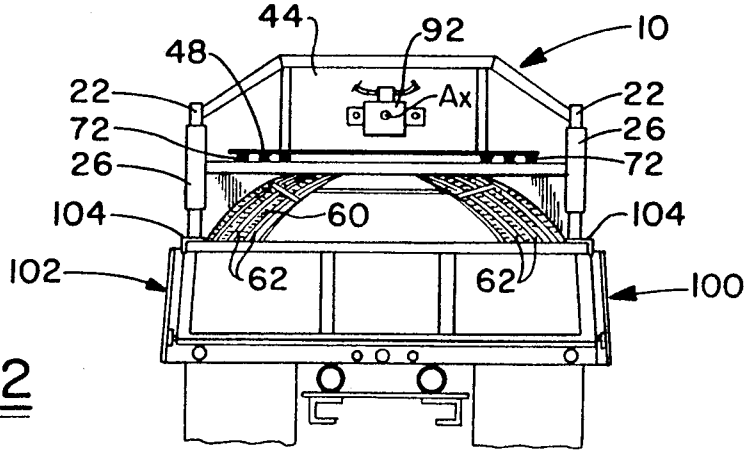
FIG. 2 is a partial rear view of the apparatus and truck illustrated in FIG. 1.
Figure 4:
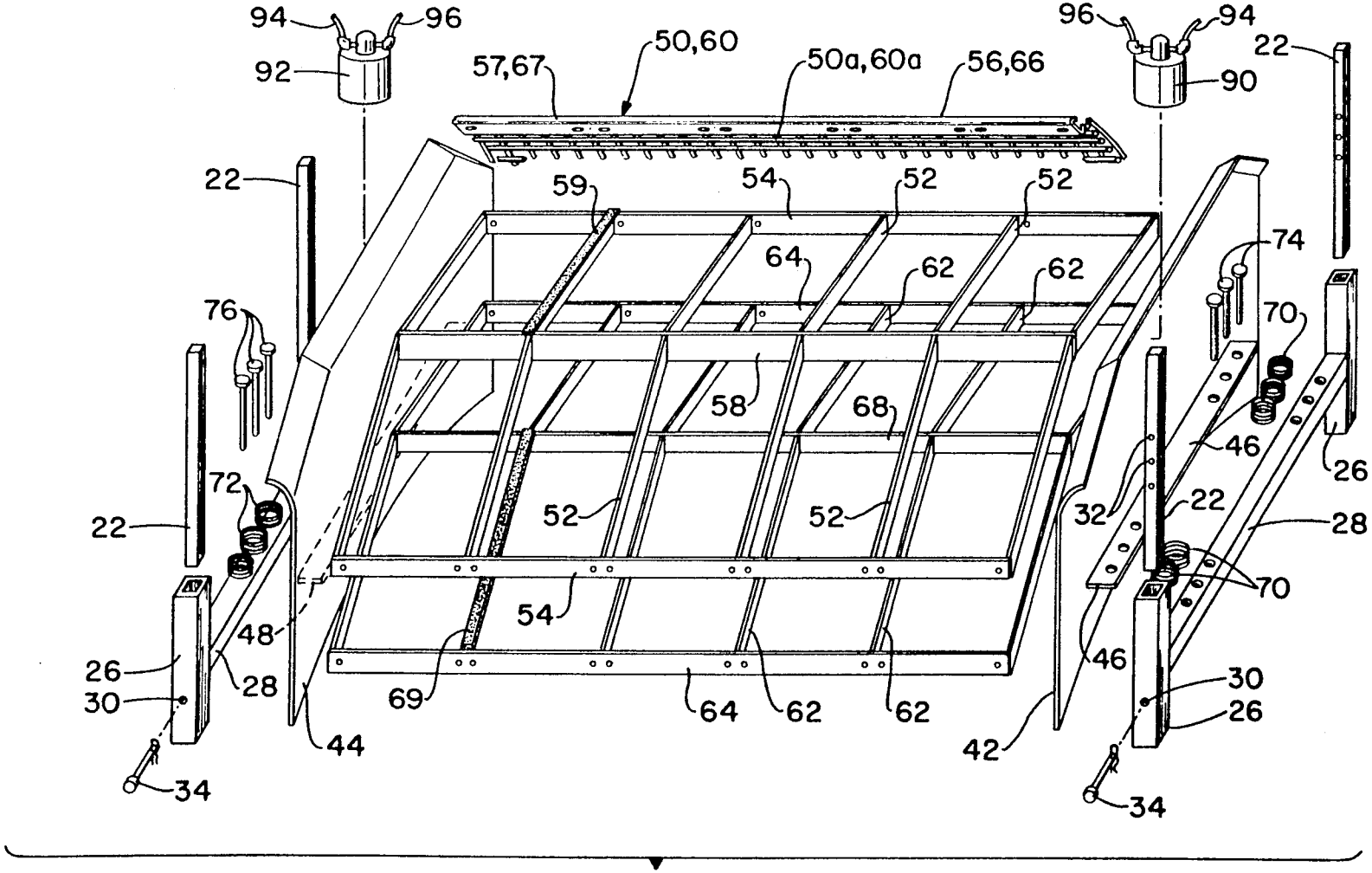
FIG. 4 is an assembly drawing illustrating the elements comprising the soil conditioning apparatus of the present invention.

Referring to FIGS. 1–4 of the drawings, a soil conditioning apparatus in accordance with this invention is illustrated and generally indicated by reference numeral 10 as such may be applied to a wheeled vehicle indicated generally by reference numeral 100. The vehicle 100 is illustrated in the drawings as a truck-type vehicle but it may also comprise a wheeled trailer or similar type of material handling equipment having a dump box or bed 102. Conventionally, the truck bed 102 is limited in its widthwise extent by well-known on-the-road restrictions while its overall length and depth extents may be varied depending upon the power and capacity designs of the particular vehicle. In any event, it will be apparent to those working and knowledgeable in the material handling arts that the present invention may be applied to various type of wheeled vehicles and it is, therefore, not considered limited to the particular dump type truck illustrated in the drawings. In the preferred embodiment, however, the invention is applied to a self-powered vehicle such as a conventional truck having a dump bed feature.

The soil conditioning apparatus 10 is a two-piece type construction comprising: (a) a substantially stationary frame 20 and, (b) a relatively movable shaker screen assembly 40 which is carried within and by the frame 20.

The frame 20 comprises four steel posts 22 which may be solid pieces, steel channels, or any other suitable configuration which will meet the duty requirements of the invention.

A post 22 is mounted at each of the corners of the bed 102 and this may be accomplished by various known techniques including welding, bolting, or using a removable pin for a temporary mounting. Preferably, a pin mounting arrangement will be used wherein post mounts already found on vehicles of this type may be used to pin mount the posts 22. The posts 22 are maintained in a vertical position within such post mounts indicated at reference numeral 104 and maintained therein via retaining pins 24 in a well-known and conventional manner.

Each of the posts 22 carries a sleeve member 26 which is slidably received on the post and two such sleeve members are carried on two forwardly positioned posts 22 while two other sleeve members 26 are carried on two rearwardly positioned posts 22. The two forwardly carried sleeve members 26 are interconnected together by a cross rail 28 which has its ends welded or otherwise rigidly affixed to a respective sleeve member 26. The sleeve members and cross rail thus form a substantially rigid assembly which may be slidably moved up or down on the two forwardly positioned posts 22. In a similar way, two other sleeve members 26 are interconnected together by a cross rail 28 to form a substantially rigid assembly which may be slidably moved up or down on the two rearwardly positioned posts 22. Each of the sleeve members 26 has a bore 30 through it while each of the posts 22 has at least one bore 32 through it, the bores 30 and 32 being axially aligned such that a retaining pin 34 may be passed therethrough to maintain the sleeve members 26 is a particular vertical position on the posts 22. The posts 22 will preferably have more than a single bore 32 such that various vertical positions of the cross rails 28 may be achieved.

The shaker screen assembly 40 comprises a forwardly positioned baffle plate 42 and a rearwardly positioned baffle plate 44 and these are interconnected together by a first pair of longitudinally extending upper rail members 54. The rails 54 may be welded or otherwise rigidly affixed to the baffle plates 42 and 44 at the ends thereof to form a rigid assembly. Fastened to the upper rails 54 are a plurality of transversely oriented rib members 52 which have terminal ends welded or otherwise rigidly affixed to the rails 54 at one end and to a longitudinally extending third rail member 58 at the opposite end. The rail member 58 is vertically displaced from the side rails 54 and it is welded or otherwise affixed to the baffle plates 42 and 44 in similar manner. Thus, the longitudinal rails 54 and 58 and the plurality of transverse ribs 52 function to define a structural configuration which is substantially arch-shaped from a longitudinal rail 54 on one side of the plates 42,44 to a longitudinal rail 54 on the opposite side of the plates 42,44.

Figure 6:
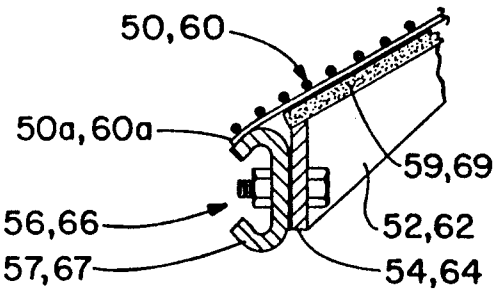
FIG. 6 is a sectional view through a side rail mounting of a soil conditioning screen as may be applied to this invention.

A soil conditioning screen 50 is draped over the arched structure comprised of the ribs 52 and rails 54,58 and it is fastened at ends **50*a* to the rails 54 via a fastening means generally indicated at reference numeral 56. The fastening of the screen 50 may be accomplished via various methods and/or techniques but, preferably, the screen edges 50***a* will be welded or otherwise rigidly affixed to a rail 57 which is then bolted to the side rail 54 in a manner such that the screen 50 may be easily removed and/or replaced. A configuration of this type is illustrated in FIG. 6 of the drawings which will be more specifically described hereinafter.

In a similar manner, the baffle plates 42 and 44 are also interconnected together via a second pair of longitudinally extending side rails 64 which are vertically displaced from the first pair of rails 54 and these are also welded or otherwise rigidly affixed to the baffle plates 42 and 44. A second plurality of transversely oriented rib members 62 are affixed at each of their one ends to a longitudinal rail 64 and at each of an opposite end to a longitudinally extending third rail member 68 which is rigidly affixed to the baffle plates 42,44 in the manner of the side rails 64. The third rail member 68 is vertically displaced from the side rails 64 and these, in conjunction with the transversely oriented ribs 62, function to define a second substantially arch-shaped structure. This second structure is vertically displaced from the first such described structure which carries the soil conditioning screen 50 thereon. This second structure may also carry a soil conditioning screen 60 which is similarly fastened to the longitudinal side rails 64 via rail members 67 which are bolted to respective side rails 64 such that the screen 60 may also be easily removed. This configuration also applies to FIG. 6 of the drawings.

The soil conditioning screens 50 and 60 may be similarly constructed screens, i.e., their screen openings may be the same size and configuration or, they may be different screen constructions adapted for passing different and/or various sizes of particulate materials through their screen openings. For example, the upper positioned screen 50 may be made of heavier gauge materials and exhibit larger screen openings as it is the top-most screen and it will receive unscreened soil materials on its surface. This screen, therefore, must be of such construction as to withstand the harsh duty imposed on it while a lower positioned screen 60 may be of a lighter weight construction as it only receives prescreened materials on its surface. In this respect, whether there is one screen 50 or two screens 50,60 mounted and/or carried by the above-described structures is not a limiting factor in this invention as this may be determined by the types of soil materials being processed. Accordingly, while a two screen configuration is shown in the drawings for the purpose of illustrating the invention, additional soil conditioning screens may be carried on additionally mounted arch-shaped structures as hereinbefore described. Practically, a two screen configuration will suffice to process most types of soil materials and in some cases a single screen may only be required. This invention, therefore, is not limited by the numbers and/or types of soil conditioning screens carried by the assembly 40.

The forwardly positioned baffle plate 42 is mounted in close proximity to the forwardly positioned cross rail 28 which is carried by the sleeve members 26 and posts 22. The plate 42 has a transversely mounted spring plate 46 welded or otherwise rigidly affixed to its outboard-facing surface and it is displaced vertically from the cross rail 28 by way of a plurality of compression springs 70. The springs 70 are maintained in position between the spring plate 46 and cross rail 28 by a pin or bolt 74 which passes through the plate 46, through the axial center of a spring 70, and through the cross rail 28. The pin or bolt may be maintained in position via any known type fastening means including a cotter pin, a threaded nut, or any other suitable fastener. In this respect, a series of springs 70 are positioned at one end of the spring plate 46 while a second series of springs 70 are positioned at the opposite end. In this configuration, it can be appreciated that the spring plate 46 and thus also the baffle plate 42 may be rocked about a central Ax axis between the two sets or series of springs 70. While the drawings show sets of springs 70 comprising three springs, any number may be used and this will depend on the type of spring selected to accomplish the requirements of the invention.

At the rearwardly positioned baffle plate 44 an identical spring plate 48 is affixed to the outboardly-facing surface of the plate and it also is positioned in close proximity to the cross rail 28 carried by the sleeve members 26 on the rearwardly positioned posts 22. The spring plate 48 is also vertically displaced from the cross rail 28 by means of a like plurality of compression springs 72 which are maintained in position via pins or bolts 76 passed through the spring plate 48, through the axial center of a spring 72, and through the cross rail 28. Again, the pins or bolts 76 are terminated via any well-known fastener in a conventional manner. The spring plate 48 and thus also the baffle plate 44 and its attachments may rock between the two sets of springs 72 about the central Ax axis in conjunction with the rocking motion of the forwardly positioned baffle plate 42.

From the foregoing description it will be appreciated that the screen assembly 40 may be rocked from side-to-side about an Ax axis between springs sets on opposite sides of the spring plates 46 and 48. This rocking action comprises a vibratory motion and may be accomplished automatically using the available hydraulic system of the vehicle which functions to operate the dump mechanism for the vehicle bed 102.

Figure 5:
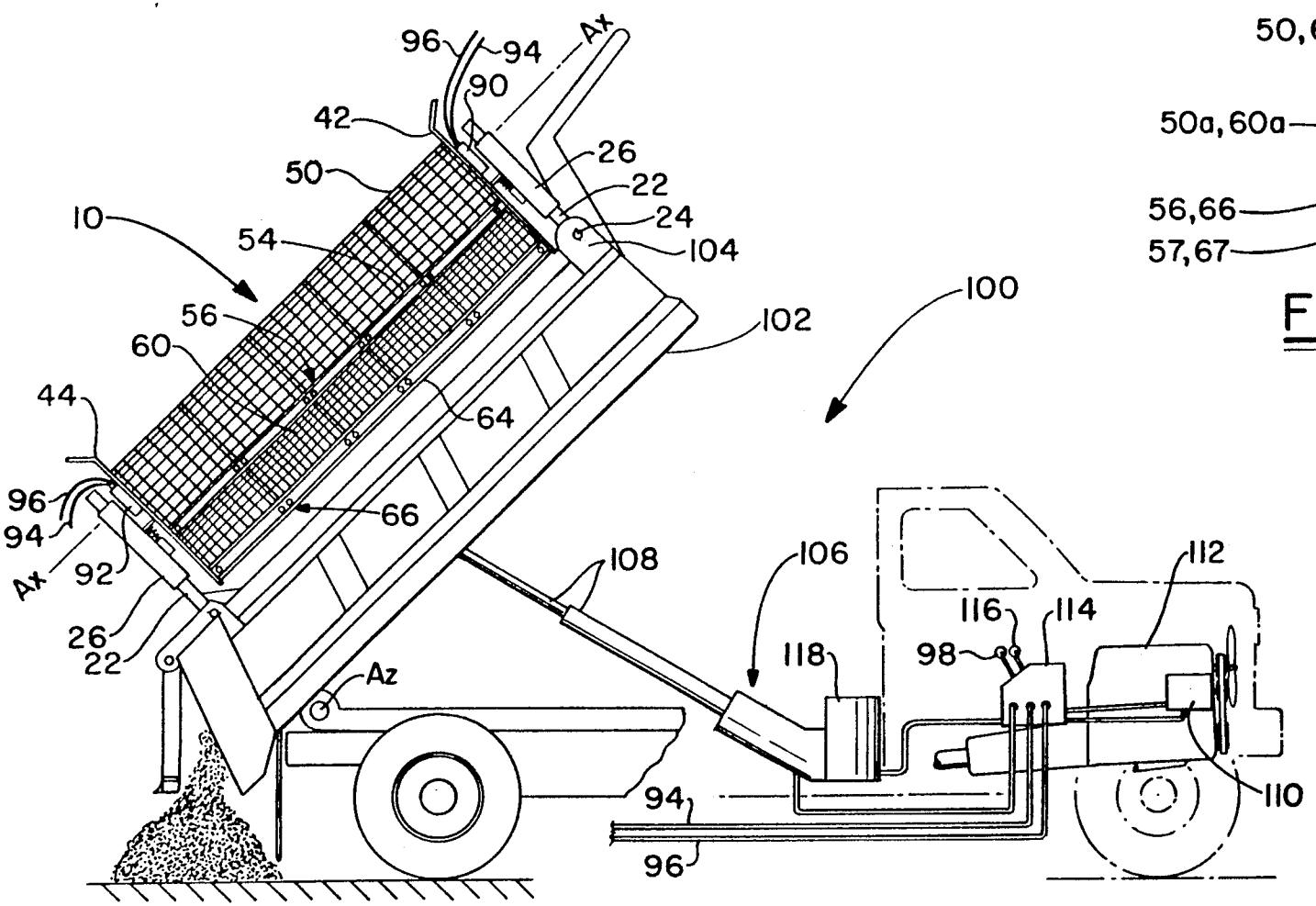
FIG. 5 is a side view similar to FIG. 1 but showing the dump bed of the truck in a raised position for delivery of conditioned soil materials contained within the dump bed.

Referring to FIG. 5 of the drawings, the vehicle dump mechanism is indicated generally by reference numeral 106 and it functions to tilt the bed 102 upwardly about a tilt axis indicated at Az. This is accomplished via telescoping hydraulic cylinders 108 which receive a hydraulic fluid pressure from a pump 110 being driven by the vehicle engine 112. The pump 110 delivers a hydraulic fluid pressure to a regulator or control unit 114 mounted within the vehicle cab and operated by the vehicle operator via a valve control lever 116. A hydraulic sump or reservoir 118 provides a supply of hydraulic fluid to the pump 110 and receives a return of fluid from the dump mechanism in a continuous cycle. This is, of course, a conventionally practiced dump mechanism that is well-known in the art.

The shaker screen assembly 40 of this invention takes advantage of the vehicle hydraulic system by mounting a first hydraulically operated eccentric vibrator motor 90 on the outboard-facing surface of the forwardly positioned baffle plate 42. In similar manner, a second hydraulically operated eccentric vibrator motor 92 is mounted on the outboard-facing surface of the rearwardly positioned baffle plate 44. The vibrator motors 90,92 each have a hydraulic fluid pressure supply line 94 connected into it and this line is also connected into the vehicle hydraulic system control unit 114 which has a valve lever 98 controlling the hydraulic fluid pressure to the motors 90 and 92. In addition, each of the vibrator motors 90 and 92 has a fluid return line 96 which is connected into the system reservoir 118 and this completes the shaker screen assembly hydraulic circuit.

It may now be appreciated that the shaker screen assembly 40 is operable from the vehicle cab by an operator who also controls the dump mechanism 106 for the vehicle dump bed 102. In this respect also, it will be recognized that the shaker screen assembly may be operated at various vibratory speeds in much the same manner as the vehicle dump mechanism 106 may be operated at various lifting speeds by merely increasing or decreasing the speed of the vehicle engine 112 via a throttle (not shown). Thus, as the vehicle engine speed is increased or decreased, the hydraulic fluid pressure from the pump 110 may be either increased or decreased and this may be used to change the vibration speed of the shaker screen assembly.

While the above description is to a preferred embodiment using hydraulically operated and controlled eccentric vibrator motors 90 and 92, it will be apparent that an identical shaker screen operation may be achieved using electrically driven eccentric vibrator motors. Accordingly, a battery power supply may be provided to operate the electric vibrator motors and this may be integrated into the electrical system already available on the vehicle. Whether hydraulically or electrically operated eccentric vibrator motors are used, the present invention is not considered limited by the type of motor as both types are readily available and in various sizes from manufacturers of such type equipment.

Referring to FIG. 6, a particular arrangement is shown as it applies to mounting of the soil conditioning screens 50 and/or 60 within the shaker assembly 40. Because the screens may be mounted in similar manner, the following description will be with respect to screen 50 and its associated members which are designated by reference numerals within the 50's range, it being understood that the description also applies to screen 60 and its associated members which are designated by reference numerals within the 60's range. The conditioning screen 50 has a terminal edge or end 50*a* which is welded, or otherwise affixed, to a respective longitudinally extending rail member 57, the member 57 being bolted at various locations along its length to the longitudinally extending side rail 54 in the manner illustrated. Because the metallic screens are being vibrated in the process of conditioning soil materials which are deposited onto the screen surface and these screens are supported via a plurality of transversely oriented metallic rib members 52, a rubber or other suitable elastomeric cushioning 59 may be interposed between the screen 50 and each of the ribs 52. The cushioning 59 may be affixed to the bottom side of the screen 50 or, alternatively, it may be fastened to each of the ribs 52. The manner of affixing the cushioning 59 may be accomplished using well-known methods and/or techniques and fastening means available in the art and, therefore, this will not be elaborated upon further inasmuch as any fastening means may be used. In any event, it will be recognized that the cushioning 59 will function to reduce wear as between the screen 50 and the ribs 52 and furthermore, such cushioning will reduce the noise level which a vibrating system of this type will obviously generate during its operation. It will, of course, be recognized that the cushioning 59 may be in various configurations and dimensions. A particular cushioning which may be used comprises the type used in the tire industry for tires and for conveyor belting. The elastomeric compounds used are very wear resistant and are conventionally cord reinforced structures. A suitable cushioning material, therefore, is considered within the rubber industry technology and may be provided by them for this purpose.

From the foregoing description and a consideration of the drawings it must be appreciated that the present invention offers advantages which are not presently found in the prior art. For example, the shaker screen assembly 40 is completely portable and may be adapted for use on various sizes, configurations, and types of wheeled and/or self-powered vehicles. In addition, the shaker screen assembly may be adapted for multiple and various types of screens to operate on various types of soil materials and the conditioned soil is deposited directly into the transporting vehicle. Further, it should be apparent that a conditioned soil may be achieved with fewer processing steps and using fewer personnel and equipments and the apparatus may be fabricated using conventional and readily available materials. Finally, because the apparatus may be adapted to utilize the power resources already available on the vehicle, the overall cost will be appreciably less than comparable equipments.

What is claimed is:

1. An apparatus for screen-conditioning soil materials into a vehicle having a dump bed which is operated either mechanically, electrically, or hydraulically by a comparable system of the vehicle, the apparatus comprising in combination:

a frame means comprising frame members mounted forwardly and rearwardly to the vehicle dump bed;

a shaker screen assembly mounted within and carried by the frame means between forwardly and rearwardly mounted frame members, the assembly comprising at least one soil conditioning screen carried on a structure which is spring-mounted with respect to the forwardly and rearwardly mounted frame members; and means operatively mounted to the shaker screen assembly to effect vibratory motion of the screen such that soil materials deposited onto the assembly are screen conditioned directly into the vehicle dump bed.

2. The apparatus as claimed in claim 1 wherein two soil conditioning screens are carried by two vertically separated structures such that soil materials deposited onto the assembly pass through both screens for two stages of soil conditioning.

3. The apparatus as claimed in claim 1 wherein the means to effect vibratory motion comprises hydraulically operated eccentric vibration motors mounted to the shaker screen assembly, said motors being operated via a vehicle hydraulic control system.

4. The apparatus as claimed in claim 1 wherein the means to effect vibratory motion comprises electrically operated eccentric vibration motors mounted to the shaker screen assembly, said motors being operated via a vehicle electric control system.

5. The apparatus as claimed in claim 1 wherein the structure which carries the soil conditioning screen comprises forwardly and rearwardly positioned baffle plates interconnected by and secured to a pair of longitudinally extending rails, said rails interconnected by a plurality of transversely oriented ribs which support the soil conditioning screen and the baffle plates are spring mounted to the forwardly and rearwardly positioned frame members.

6. The apparatus as claimed in claim 5 wherein the baffle plates are interconnected and secured to two pairs of vertically separated longitudinally extending rails, an upper pair interconnected by a plurality of transversely oriented ribs which support and carry a first soil conditioning screen while a lower pair are interconnected by a plurality of transversely oriented ribs which support and carry a second soil conditioning screen.

7. The apparatus as claimed in claim 6 wherein ribs are in an arched configuration between pairs of longitudinally extending rails and the first and second soil conditioning screens are in relative spaced vertical positions with respect to each other.

8. The apparatus as claimed in claim 7 wherein the first soil conditioning screen is of a configuration to provide a first stage of soil conditioning for soil materials deposited onto it while the second screen is of a configuration to provide a second finer stage of soil conditioning for soil materials deposited onto it from the first screen.

9. The apparatus as claimed in claim 1 wherein the frame means comprises four posts, a first pair of posts mounted forwardly on the vehicle dump bed while a second pair of posts is mounted rearwardly on the vehicle dump bed, said post pairs being interconnected by transversely oriented cross rails which are each spring mounted with respect to the shaker screen assembly.

10. The apparatus as claimed in claim 9 wherein the posts are removably pin mounted to the dump bed and the cross rails are carried on the posts via sleeve members which are movable vertically to various positions on the posts and are maintained at a particular position via a retaining pin.

11. The apparatus as claimed in claim 7 wherein a plurality of cushioning members are interposed between the screen and the plurality of transversely oriented ribs.

12. An apparatus for screen conditioning soil materials into a vehicle dump bed having a forward end selectively raised or lowered either electrically or hydraulically using a comparable system of the vehicle, the apparatus comprising in combination:

a frame means comprising at least four posts mounted at the corners of the dump bed, a forwardly mounted pair and a rearwardly mounted pair of posts each having interconnecting cross rails which are movable vertically on the posts but which are maintained at a particular height by fastening means connected into the posts;

a shaker screen assembly mounted within the frame means between the forwardly and rearwardly positioned cross rails, the assembly comprising at least one soil conditioning screen carried between a forward baffle plate and a rearward baffle plate, said baffle plates being interconnected by longitudinally extending rails which are affixed to the plates to form a substantially rigid assembly and the screen is carried thereon in an arched configuration between the rails, each said baffle plate having a transversely oriented spring plate in parallel spaced relationship to a respective cross rail and a plurality of compression springs are interposed therebetween such that the baffle plates are jounced on the springs; and eccentric vibrator motor means mounted on each of the baffle plates and operated by a comparable vehicle system to effect a vibration of the screen when soil materials are deposited thereon such that conditioned soil is deposited directly into the vehicle dump bed.

13. The apparatus as claimed in claim 12 wherein the motor means comprises electrically driven eccentric vibrator motors which are operated via a vehicle operator using an electrical system of the vehicle.

14. The apparatus as claimed in claim 12 wherein the motor means comprises hydraulically driven eccentric vibrator motors which are operated via a vehicle operator using a hydraulic system of the vehicle.

15. The apparatus as claimed in claim 12 wherein the soil conditioning screen is formed to an arched configuration by a plurality of rib members which are affixed at one of their ends to a side rail and at an opposite end to a third longitudinally extending rail that is affixed to the forward and rearward baffle plates.

16. The apparatus as claimed in claim 15 wherein cushioning means are interposed between the screen and the ribs at the rib positions.

17. The apparatus as claimed in claim 12 wherein the baffle plates are interconnected via a pair of upper positioned longitudinally extending rails and a pair of lower positioned longitudinally extending rails and a soil conditioning screen is carried in an arched configuration between the upper rails while a second soil conditioning screen is carried in an arched configuration between the lower rails such that two stages of soil conditioning are accomplished when soil materials are deposited onto the surface of the upper screen.

18. The apparatus as claimed in claim 17 wherein the two soil conditioning screens exhibit different screen openings, the upper screen exhibiting larger screen openings while the lower screen exhibits smaller screen openings.

19. The apparatus as claimed in claim 12 wherein the vehicle dump bed is operated hydraulically by a comparable system including a hydraulic pump driven by the vehicle engine and a hydraulic control unit operated by a vehicle operator, said eccentric vibrator motors being hydraulically driven motors which are connected into the vehicle system through the control unit wherein the vehicle operator controls the speed of the motors and thus also the speed of vibration of the soil conditioning screen by way of the engine accelerator of the vehicle.

* * * * *